United States Patent [19]

Orlandi et al.

[11] 4,073,127

[45] Feb. 14, 1978

[54] TWINING AND CABLING SYSTEM

[75] Inventors: John F. Orlandi, Lombard; John E. Rauch, St. Charles, both of Ill.

[73] Assignee: Belden Corporation, Geneva, Ill.

[21] Appl. No.: 765,992

[22] Filed: Feb. 7, 1977

[51] Int. Cl.[2] ..... D07B 3/12; D07B 3/00

[52] U.S. Cl. ..... 57/58.36; 57/14; 57/59; 57/115

[58] Field of Search ..... 57/1 R, 34 R, 13, 14, 57/58.3, 58.38, 59, 60, 106, 115, 127.5

[56] References Cited

U.S. PATENT DOCUMENTS

| | | | |
|---|---|---|---|
| 2,703,958 | 3/1955 | Halleux | 57/58.36 |
| 3,360,919 | 1/1968 | Burr | 57/59 |
| 3,397,528 | 8/1968 | Zermati | 57/58.36 |
| 3,740,938 | 6/1973 | Kopczynski | 57/58.36 |
| 3,763,899 | 10/1973 | Orlandi | 57/59 X |
| 3,827,225 | 8/1974 | Schoerner | 57/13 |
| 4,015,415 | 4/1977 | Otsuki et al. | 57/13 X |

*Primary Examiner*—Donald Watkins
*Attorney, Agent, or Firm*—Fitch, Even, Tabin & Leudeka

[57] ABSTRACT

A system for twining and cabling pairs of elongate elements such as wire is disclosed wherein pairs of filaments are first twined by twining apparatus and then passed to a cabling device. The twining apparatus includes rearward and forward supply reels from which elongate filaments are drawn off over payoff arms under constant tension, the rear filaments being passed around the forward supply reels by flyer assemblies which twine the rear filaments about the forward filaments whereafter the twined pairs of filaments are passed to the cabling device.

24 Claims, 7 Drawing Figures

64
58
60
62
24
66
56
66
36
34
54
278'
276'
280'
284'
288'
286'
44
232'
285'
12
4.
106
112
3.
26b
110
26c
118
86
23
144
146
154
184
196
94
96
152
36
50
186
100
56
58
142
100
180a
40
38
278
186
54
236
276
182a
280
284
186
288
234
254
232
282'
285
198
286
260
262
242
268
6.
6.
186
7.
7.
46
4.
40
186
202
166
168
168
174
170
204
184
184
196
194
172
200
158
156
22
16b
160
164
158
3.
162

TWINING AND CABLING SYSTEM

The present invention relates generally to twining and cabling systems, and more particularly to a twining and cabling system having novel means for effecting constant tension on elongate filaments as they are paid out from supply reels, and including novel flyer assemblies for passing rearward filaments around forward supply reels and causing the guided filaments to be twined with filaments paid out from the forward supply reels in a manner to effect uniform twining of pairs of filaments.

The known commercially available apparatus for twining elongate filaments are not economical for use in twining and cabling in one operation because of excessive floor space requirements and the relatively high cost of the individual twiners. Additionally, twining apparatus presently available generally feature live let-off or supply reels which exhibit inherent tension variations as the elongate filaments paid out from the respective supply reels recede from the outside flanges to the barrels of the reels. If periodic adjustments are not made to compensate for variations in tension, nonuniform twisting of the filaments can occur.

One of the primary objects of the present invention is to overcome the disadvantages found in the prior art apparatus and provide a compact twining system that is practical to use for twining and cabling pairs of elongate filaments in one operation, thus substantially reducing manufacturing costs.

Another object of the present invention is to provide a twining and cabling system which includes novel flyer means for effecting let-off of elongate filaments from supply reels in a manner to maintain the filaments under substantially constant tension as they are fed to a pairing and twisting position, whereby uniform twisting of pairs of filaments is accomplished and a superior product is obtained.

A further object of the present invention is to provide novel flyer guide means to guide an elongate filament from a rear supply reel around a forward guide reel simultaneously with rotating the guided filament about the axis of the forward supply reel, the flyer guide means including a pair of lightweight rotatable flyer arms having radial outer ends connected by pairs of cables which support guide elements through which the elongate filaments is guided around the forward supply reel preparatory to twining with an elongate filament paid out from the forward supply reel.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
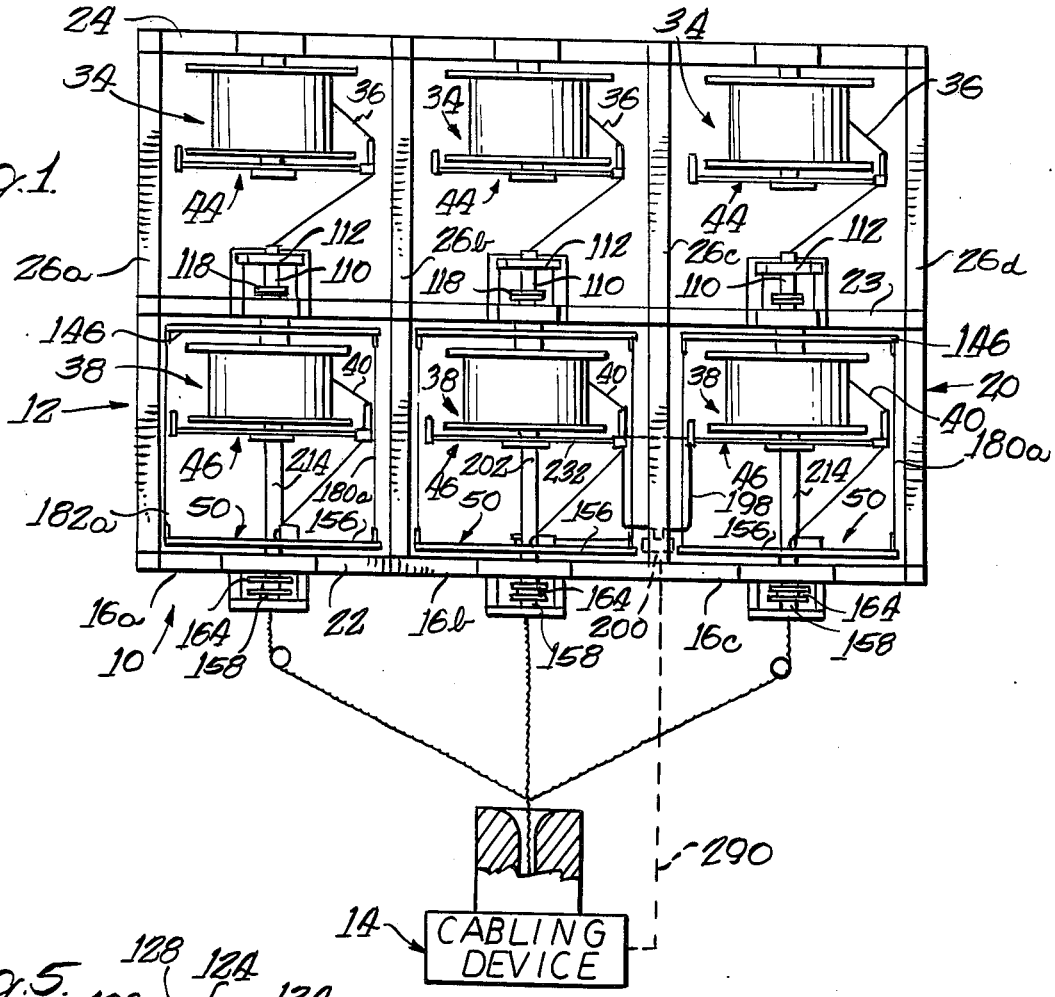
FIG. 1 is a plan view of a system for twining and cabling elongate filaments in accordance with the present invention.
Figure 6:
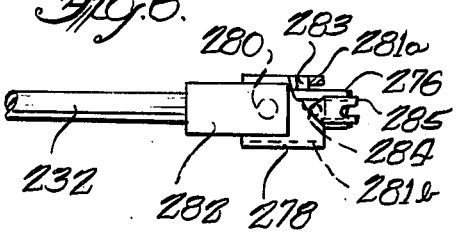
Figure 7:
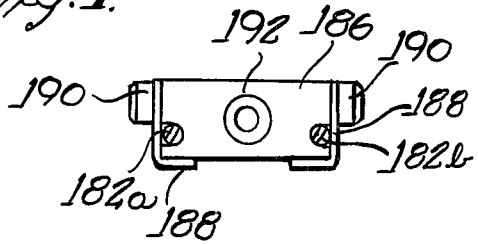
Figure 1:
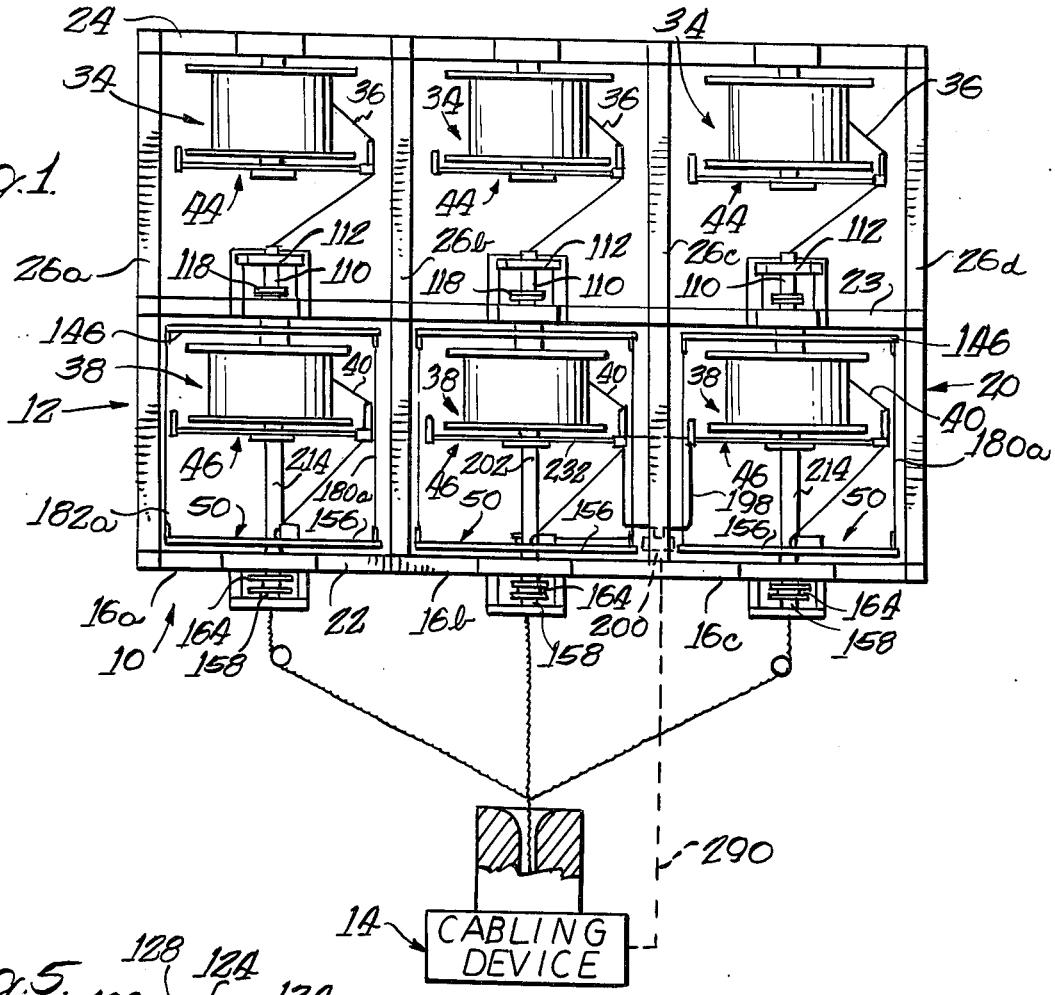
Figure 5:
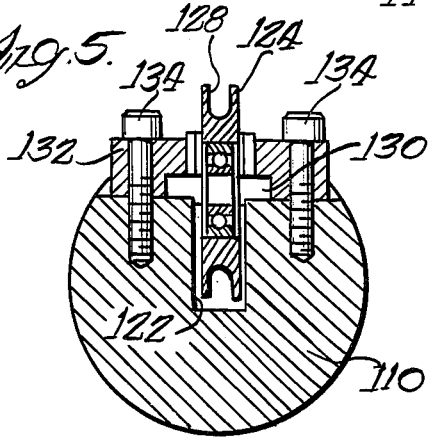
Figure 6:
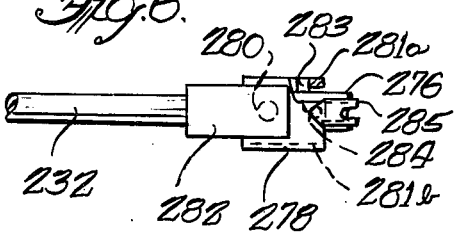
Figure 7:
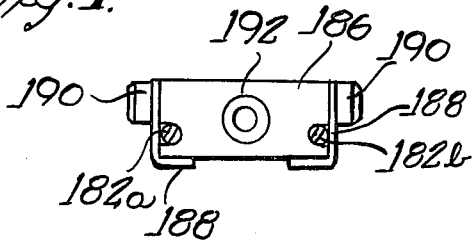
Figure 2:
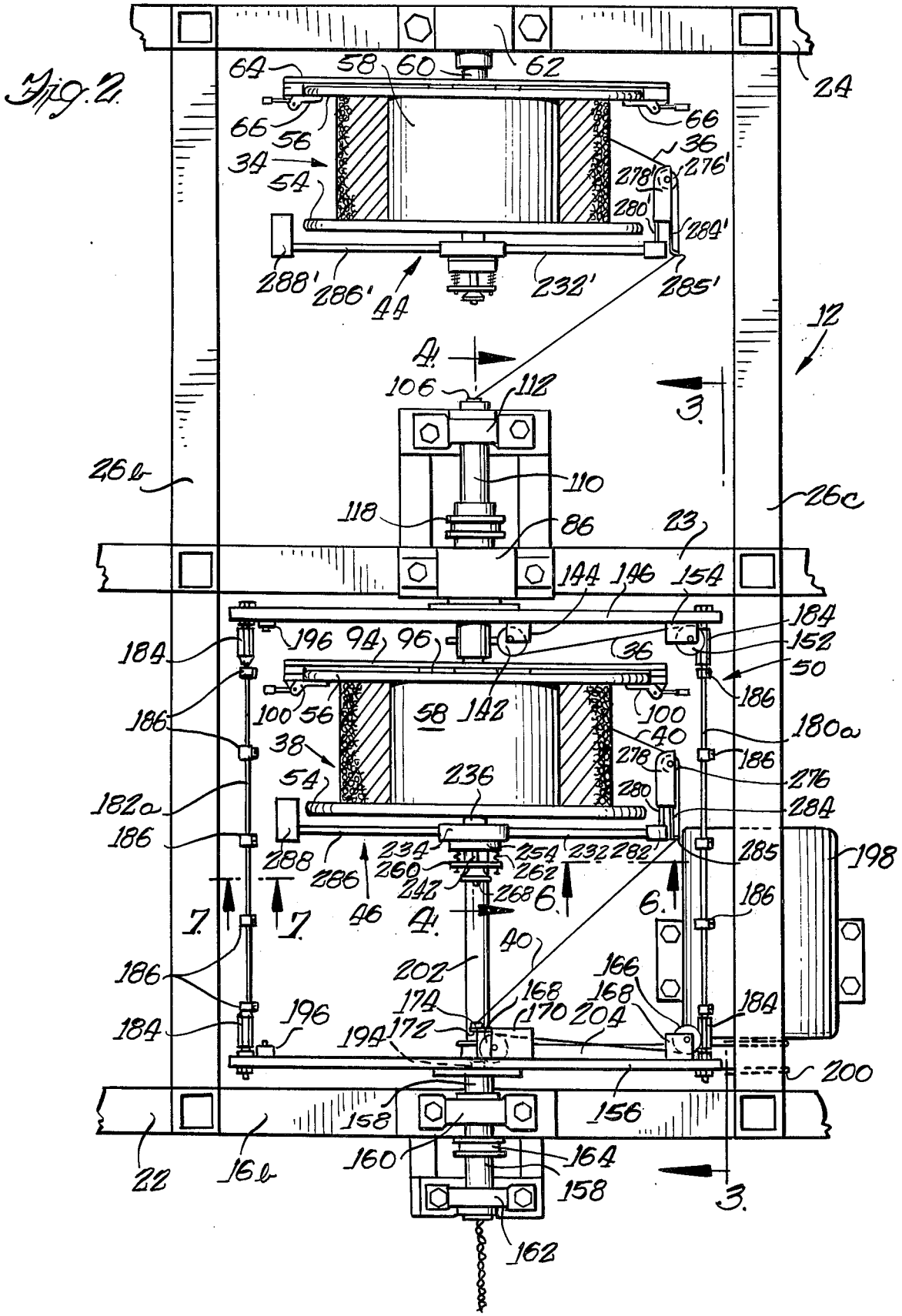
FIG. 2 is an enlarged plan view of one station of the twining apparatus employed in the system of FIG. 1 for uniformly twining a pair of elongate filaments about each other.

FIG. 6 is a view taken substantially along the line 6—6 of FIG. 2, enlarged in scale and looking in the direction of the arrows, illustrating the outer guide end of a payoff flyer arm for a supply reel; and FIG. 7 is an enlarged partial sectional view, taken substantially along the line 7—7 of FIG. 2 and rotated 90 degrees, showing a filament guide element supported on a pair of support cables of the flyer guide;

Referring now to the drawings, and in particular to FIG. 1, a system for twining and cabling elongate filaments in accordance with the present invention is indicated generally at 10. The twining and cabling system 10 will be described herein, by way of example, in connection with the twining and cabling of elongate wire filaments wherein a plurality of wire filaments are formed into uniformly twisted or twined pairs of wire filaments which are thereafter cabled to form a wire cable. To this end, the twining and cabling system 10 includes apparatus, indicated generally at 12, for twining pairs of elongate wire filaments whereafter the twined pairs of filaments are fed to a cabling device, indicated generally at 14, which is cooperative with the twining apparatus 12 to receive the twined pairs of elongate elements and effect cabling thereof.

In the illustrated embodiment, the twining apparatus 12 includes three twining or twisting stations, indicated at **16*a*, 16*b* and 16*c*, each of which includes substantially identical elements. The stations 16*a*, 16*b* and 16*c* are disposed in substantially parallel side-by-side relation with each station defining a longitudinal axis parallel to and spaced laterally from the longitudinal axes of the other two stations. The cabling device 14 is preferably disposed in axial alignment with the longitudinal axis of the center twining station 16*b* as shown in FIG. 1**.

Figure 3:
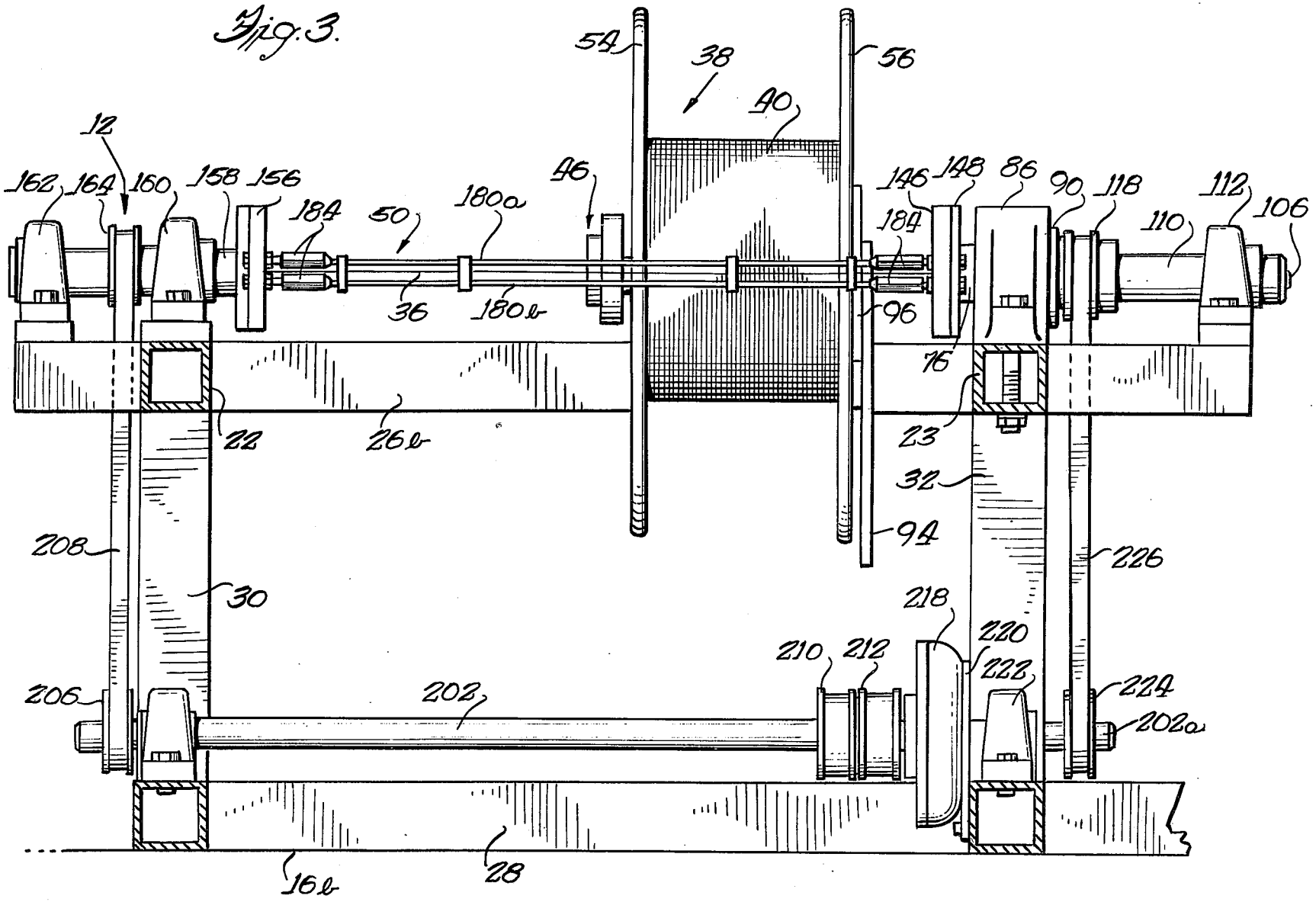
FIG. 3 is a vertical sectional view taken substantially along the line 3—3 of FIG. 2, looking in the direction of the arrows.

Describing briefly the various components comprising the twining and cabling system 10, the twining apparatus 12 includes frame means, indicated generally at 20, which may be fabricated from tubular steel or other suitable material. The frame means 20 includes transversely extending frame members 22, 23 and 24 to which are secured a plurality of longitudinally extending frame members **26*a–d* equidistantly spaced along the frame members 22 and 24 and coplanar therewith. As seen in FIG. 3, the framework comprising the frame members 22, 23, 24 and 26*a–d* is supported above a suitable floor engaging framework, indicated at 28 in FIG. 3, by a plurality of vertical support members two of which are indicated at 30 and 32. The twining station 16*a* is defined between the frame members 26*a* and 26*b*; the station 16*b* is defined between the frame members 26*b* and 26*c*; and the station 16*c* is defined between the frame members 26*c* and 26*d*.**

Briefly, each twining station **16*a*, *b* and *c* includes a rearward supply reel or spool, indicated generally at 34, adapted to support a first elongate filament 36 in wound relation thereon in a manner to facilitate let-off or payout of the elongate filament. Each of the rear supply reels 34 is nonrotatably supported with its axis coplanar with, parallel to and midway between the associated frame members 26*a, b, 26b, c* and 26*c, d,*** respectively, so as to coincide with the longitudinal axes of the respective twining stations.

Each of the twining stations 16*a–c* further includes a forward supply reel or spool, indicated generally at 38, which is substantially identical to the associated rear supply reel 34 and is rotatably supported with its axis coincident with the axis of the associated rear supply reel. As will be described more fully herein, while the forward supply reels are rotatably supported they are counterweighted to prevent free rotation. Each forward supply reel 38 is adapted to support a second elongate filament 40 in wound relation thereon in a manner to facilitate let-off or pay-out of the second elongate filament.

The twining stations 16*a–c* include means to receive and guide the first elongate filaments 36 outwardly past the associated forward supply reels 38 whereafter the first elongate filaments are brought to positions coincident with the axes of the respective forward supply reels for twining with the associated second elongate filaments 40 whereafter the twined pairs of elongate filaments are passed to the cabling device 14 which is operative to cable the three pairs of twined elongate filaments. In the illustrated embodiment, the elongate filaments 36 and 40 comprise wire filaments of predetermined gauge suitable for twining and cabling as is known.

An important feature of the present invention lies in the provision of flyer means for each twining station 16*a–c* in the form of payoff flyers, indicated generally at 44 and 46, which are operatively associated, respectively, with the rearward and forward supply reels 34 and 38 for effecting pay-out or let-off of the elongate filaments 36 and 40 under substantially uniform constant tension as the filaments are paid out from the supply reels.

Another important feature of the invention lies in the provision of lightweight flyer guide means, indicated generally at 50, for each of the twining sections 16*a–c* to guide the elongate filaments 36 about the forward supply reels 38 preparatory to twining with the filaments 40 during operation.

Referring again to one of the twining stations, such as 16*b*, for a more detailed description of the various elements of the twining apparatus 12, each of the rear and forward supply reels 34 and 38 includes a pair of parallel filament confining circular flanges 54 and 56 which are secured on and cooperate with a central hub 58 to receive the respective elongate filaments 36 and 40 in wound relation thereon. The hubs 58 and their associated flanges 54 and 56 have axial openings therethrough to facilitate mounting of the reels on support shafts.

Each of the rear supply reels 34 is releasably nonrotatably mounted on a stationary support shaft 60 which is supported by a mounting bracket 62 affixed to the frame means 20. A retaining plate 64 is fixedly secured to the shaft 60 in perpendicular relation thereto and has a pair of identical toggle retaining clamps 66 secured thereon in diametrically opposed relation. The retaining clamps 66 are manually operable to secure the flange 56 of the rear supply reel 34 against the retaining plate 64 in fixed relation thereagainst.

The forward supply reels 38 are supported in a manner to facilitate "floating" of the forward supply reels rather than being supported in nonrotating relation as are the rear supply reels 34. To this end, and referring to FIGS. 2, 3 and 4, each of the forward supply reels 38 has its hub portion 58 received over and supported on a support shaft 70 which has an end portion 70*a* supported within a tubular flyer shaft 76 through pairs of isolation bearings 78, the shaft end portion 70*a* being retained in mounted relation within the isolation bearings by a lock nut 82. The tubular flyer shaft 76 has a sleeve 84 affixed to its outer surface and rotatably supported by a pillow block 86 through suitable bearings 88. The pillow block 86 is secured to the transverse frame member 24 as shown in FIGS. 2 and 3. A retaining ring 90 is mounted on the tubular flyer shaft 76 to limit longitudinal movement thereof relative to the pillow block 86.

As thus described, the support shaft 70 for the forward supply reel 38 is rotatable about its longitudinal axis. To prevent free rotation of the forward supply reel 38, a counterweight or stability weight 94 is mounted on the support shaft 70 adjacent the forward end of the flyer shaft 76 and has a free plate 96 secured thereto as by screws 98. The counterweight 94 has a pair of toggle retaining clamps 100 mounted thereon in positions to releasably retain the forward reel flange 56 in fixed relation to the counterweight. The counterweight 94 has its center of gravity eccentric to the axis of the support shaft 70 and is of sufficient weight to prevent free rotation of the forward supply reel 38 when clamped thereagainst even though the tubular flyer shaft 76 is caused to rotate during operation as will be described more fully below. The counterweight 94 thus provides a "floating" support of the forward supply reel 38.

As shown in FIGS. 1 and 2, the elongate filament 36 is paid out from the rear supply reel 34 over the pay-off flyer 44 and is drawn through an eyelet or guide bushing 106 fixedly secured in an axial bore 108 in an adapter shaft 110. The adapter shaft 110 has its rearward end portion rotatably supported within a pillow block 112 affixed to the frame means 20, and has its forward end affixed within an axial counterbore 114 within the tubular flyer shaft 76 by a transverse roll pin 116. A timing belt pulley 118 is fixed on the adapter shaft 110 in a manner to facilitate selective rotation of the adapter shaft and associated flyer shaft 76 as will be discussed more fully below.

Figure 5:
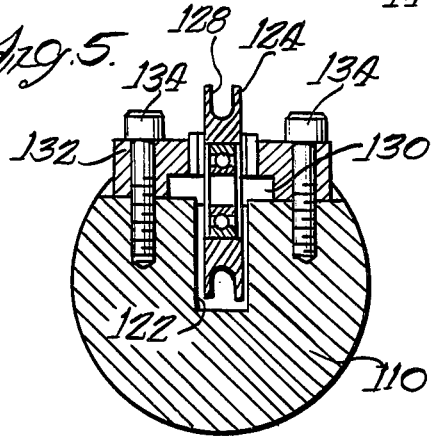
FIG. 5 is an enlarged partial transverse sectional view taken substantially along the line 5—5 of FIG. 4.
Figure 4:
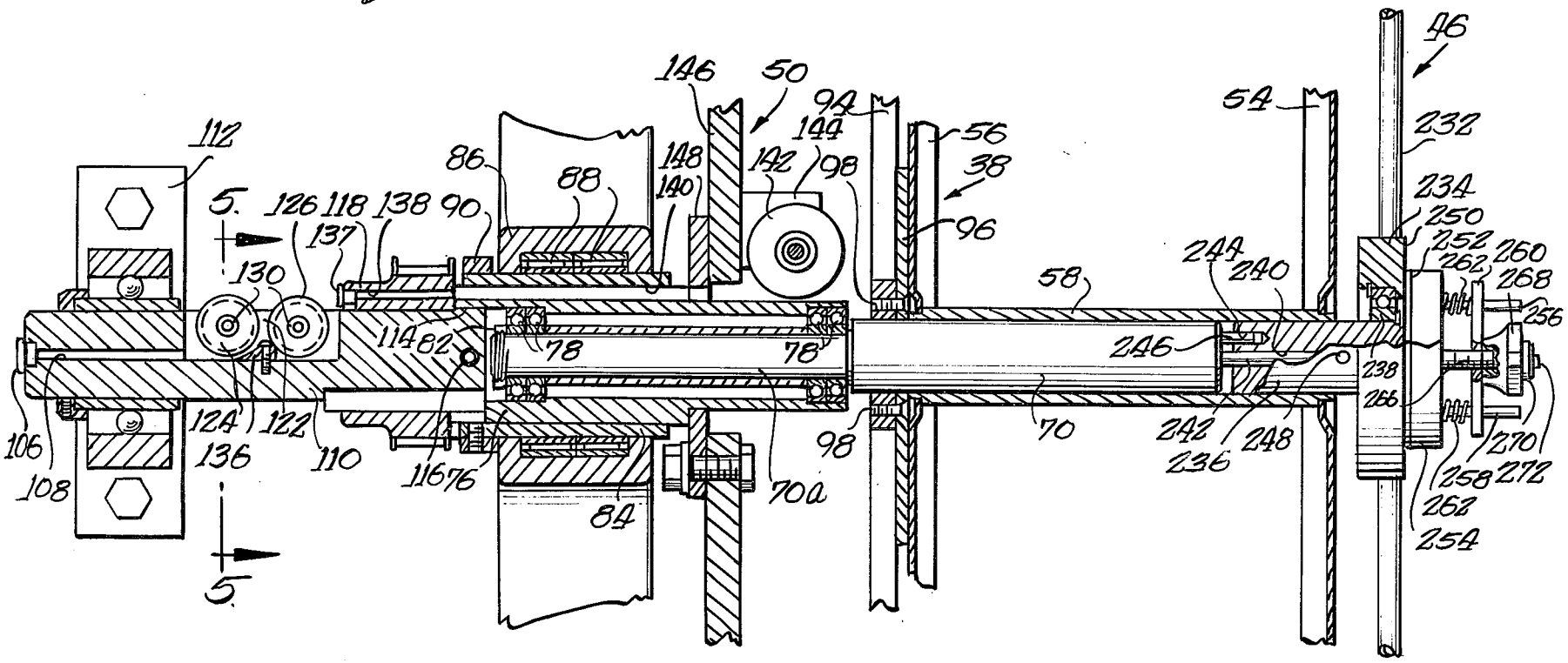
FIG. 4 is an enlarged partial longitudinal sectional view taken substantially along the line 4—4 of FIG. 2 looking in the direction of the arrows.

With particular reference to FIGS. 4 and 5, the axial guide bore 108 in the adapter shaft 110 terminates at its inner end in a radial slot 122 in which is rotatably mounted a pair of identical coplanar guide rollers 124 and 126 each of which has a peripheral groove 128 for guiding the elongate filament 36. The guide rollers 124 and 126 are rotatably supported on a pair of support shafts 130 each of which is mounted on the adapter shaft 110 by a clamp 132 and associated clamping screws 134 as shown in FIG. 5. A guide member 136 is mounted within the radial slot 122 as shown in FIG. 4 to guide the rear filament 36 partially about the guide roller 124 whereafter the elongate filament 36 is passed partially over the guide roller 126 and through an eyelet or guide bushing 137 secured within a guide bore 138 in the timing belt pulley 118. From the guide bore 138, the filament 36 is passed through a guide bore 140 in the flyer shaft 76, the guide bores 140 and 138 being axially aligned.

From the guide bore 140 in the flyer shaft 76, the elongate filament 36 is guided about a pulley 142 rotatably mounted on a pulley support bracket 144 secured to a flyer arm 146. The flyer arm 146 forms a portion of the flyer guide means 50 which is adapted to guide the elongate filament 36 about the forward supply reel 38 so as not to interfere with the elongate filament 40 and payoff flyer 46 associated with the forward supply reel 38. The flyer arm 146 is fixedly secured to the flyer shaft 76 for rotation therewith through a mounting plate 148 to which the flyer arm 146 is suitably secured, the mounting plate 148 being fixedly mounted on the flyer shaft as by welding or the like as shown in FIG. 4. From the guide pulley 142, the elongate filament 36 passes radially outwardly over a guide pulley 152 which is rotatably supported adjacent the outer end of the flyer arm 146 by a support bracket 154.

From the guide pulley 152, the filament 36 is guided to a second or forward radial flyer arm 156 which is substantially identical to the flyer arm 146 and is mounted on the rearward end of a flyer shaft 158 parallel to the flyer arm 146. The flyer shaft 158 is tubular and is supported by the frame means 20 through a pair of bearing pillow blocks 160 and 162 so that its axis is axially aligned with the axis of the supply reels 34 and 38. The flyer shaft 158 has a drive pulley 164 affixed thereon to facilitate rotational driving of the flyer arm 156 in synchronized relation with the flyer arm 146 as will be described. The forward flyer arm 156 is secured to the rearward end of the flyer shaft 158 in normal relation thereto and rotatably supports a guide pulley 166 through a support bracket 168 mounted on one end of the flyer arm 156 in identical fashion to the mounting of the guide pulley 152 on the flyer arm 146.

The flyer arm 156 also has an inner guide pulley 168 rotatably supported thereon through a support bracket 170 affixed to the flyer arm 156 adjacent its axis of rotation. The support bracket 170 has a radially directed arm 172 thereon which supports an annular eyelet or guide bushing 174 in axial alignment with the flyer shaft 158. The guide bushing 174 serves to receive the elongate filament 40 from the forward supply reel 38 and guide it to the axis of the flyer shaft 158 as will be hereinafter described.

The radial flyer arms 146 and 156 are made of a suitable strength lightweight material such as aluminum and have their corresponding radial ends interconnected through pairs of parallel cables 180*a*, and 180*b* and 182*a*, 182*b* so that the axes of the flyer arms lie in a common plane. The ends of the cables 180*a*, *b* and 182*a*, *b* are connected to the respective flyer arms 146 and 156 through identical stud end fittings 184 which are adjustable to establish uniform tension in the connecting cables and assure that the flyer arms are in parallel relation. The cables 180*a*, *b* and 182*a*, *b* preferably comprise wire rope of approximately ⅛ diameter such as commercially available aircraft cable. Each pair of cables 180*a*, *b* and 182*a*, *b* supports a plurality of filament guides 186 in spaced relation along their lengths, there being six such filament guides on each pair of cables in the illustrated embodiment.

Each of the filament guides 186 is secured to and between its associated pair of support cables through L-shaped clamps 188 and screws 190, as best seen in FIG. 7. Each of the filament guides has an annular eyelet or guide bushing 192 supported within a central opening through the filament guide. In this manner, the rear filament 36 may be guided about the guide pulleys 142 and 152 from the guide bore 140, passed through the filament guides 186 on the cables 180*a*, *b* and about the guide pulleys 166 and 168 whereafter the filament 36 is passed through an annular eyelet or guide bushing 194 disposed within the axial passage through the tubular flyer shaft 158. As the filament 36 passes through the guide bushing 194 it is in side-by-side relation with the forward filament 40 which is passed through the guide bushing 194 from the guide 174. To provide balanced flyer arms 146 and 156, suitable counterweights 196 are provided on the flyer arms opposite the pulleys 152 and 166 and their associated support brackets. The filament guides 186 on the pairs of cables 180*a*, *b* and 182*a*, *b* are preferably identical to balance the flyer guide means 50.

As the filaments 36 and 40 are passed through the guide bushing 194, they are twined or twisted about each other. Such twining or twisting is effected by selective rotation of the flyer arms 146 and 156 so as to rotate the filament 36 about the axis of the forward supply reel 38 and the forward filament 40 as it passes through the guide bushing 194. To effect such selective rotation of the flyer arms 146 and 156, an electric drive motor 198 is mounted on the frame means 20 and has an output drive pulley 200 interconnected to a main shaft 202 through a suitable drive belt 204. The drive motor 198 preferably comprises a suitable three phase constant speed electric motor. The main shaft 202 is supported for rotation about an axis parallel to the axis of rotation of the supply reels 34 and 38, and has a forwardly disposed pulley 206 thereon which is interconnected through a timing belt 208 to the aforedescribed drive pulley 164 on the flyer shaft 158. The main shaft 202 also has a pair of drive pulleys 210 and 212 fixedly secured thereon which are connected through suitable timing belts to secondary shafts 214 (FIG. 1) disposed below the filament supply reels in the twining stations 16*a* and 16*c*, the shafts 214 being adapted for driving connection to the associated flyer shafts of stations 16*a* and 16*c* similar to the rotational drive for flyer shaft 158.

As best seen in FIG. 3, the main shaft 202 has a forward section which supports the drive pulleys 206, 210 and 212, the forward section being connected to a rearward shaft end 202*a* through a conventional torque brake 218 of known design. The torque brake 218 is supported by the framework 28 through a support bracket 220 and is coupled to the rear shaft end 202*a* which is rotatable within a bearing pillow block 222. The shaft end portion 202*a* of the main shaft 202 has a drive pulley 224 fixed thereon which is interconnected to the aforedescribed timing belt pulley 118 through a timing belt 226. In this manner, the flyer arms 146 and 156 may be driven in synchronized relation at a desired rotational speed through proper selection of the drive pulleys, drive motor 198 and associated interconnecting timing belts.

As noted, an important feature of the present invention lies in the provision of the payoff flyers 44 and 46 operatively associated, respectively, with the filament supply reels 34 and 38 to effect pay-out of the elongate filaments 36 and 40 from the supply reels under substantially uniform constant tension. The payoff flyers 44 and 46 are substantially identical in construction so that only the forward payoff flyer 46 will be described in detail.

With reference to FIG. 4, taken in conjunction with FIGS. 2 and 6, the payoff flyer 46 includes a payoff arm 232 which is mounted on an annular support 234 so as to extend radially outwardly therefrom. The annular support 234 is rotatably mounted on a cylindrical shaft 236 through a bearing 238 so that the payoff arm 232 is rotatable about the axis of shaft 236 in a plane perpendicular thereto. The shaft 236 has a diameter substantially equal to the diameter of the shaft 70 and is adapted to be received within the tubular hub 58 of the filament supply reel 38 when mounted on support shaft 70, as seen in FIG. 4. To this end the shaft 70 is made shorter in length than the reel hub 58 so that a portion of the reel hub extends axially outwardly from the shaft 70. The shaft 236 has an axial bore 240 therethrough to allow the shaft 236 to be received over a rod 242 secured to and extending axially outwardly from the outer end of the shaft 70. The shaft 236 is further provided with a bore 244 which is adapted to receive a locating pin 246 affixed to the outer end of the shaft 70 so as to prevent relative rotation between the shafts 70 and 236. A suitable set screw 248 releasably retains the shaft 236 in fixed axial position on the rod 242.

The annular support member 234 has an outer radial surface 250 thereon which provides a braking surface for engagement with a friction pad 252 secured on a brake plate 254. The brake plate 254 is slidably received on and supported by the rod 242 and has a pair of parallel guide rods 256 and 258 secured in normal relation thereto. A control plate 260 having a suitable center aperture is received on and supported by the rod 242 and has a pair of openings therethrough adapted to receive the rods 256 and 258. A pair of identical compression springs 262 are received over the guide rods 256 and 258 between the brake plate 254 and the control plate 260. The outer end of the rod 242 is threaded at 266 and receives an adjustment nut 268 in threaded engagement thereon such that the adjustment nut may be moved axially along the rod 242 to selectively vary the pressure applied against the brake surface 250 by the friction pad 252 through the compression springs 262. A lock nut 270 is threadedly mounted on a reduced diameter thread end portion 272 of the rod 242 so as to be lockable against the adjustment nut 268 and prevent unintentional rotation thereof as is known. By adjustment of the frictional pressure applied against the planar braking surface 250 on the support member 234, the freedom of rotation of the payoff arm 232 may be selectively controlled.

Referring to FIGS. 2 and 6, the payoff arm 232 supports a rotatable guide pulley 276 on its outer end over which is guided the filament 40 as it is paid out from the supply reel 38. The guide pulley 276 is mounted on payoff arm 232 through a bracket 278 and support rod 280 as to be radially spaced from the largest diameter which the wound reel 38 will assume. The support rod 280 is mounted on the outer end of the payoff arm 232 through a connecting block 282 such that the support rod 280 is rotatable about its own axis and is perpendicular to the axis of the payoff arm 232 and parallel to the axis of rotation thereof. The bracket 278 is fixed to the support rod 280 and has parallel side walls 281*a, b* which support a rotatable shaft 283 upon which is mounted the guide pulley 276. A guide arm 284 is secured to the bracket 278 parallel to rod 280 and has a bifurcated guide piece 285 thereon which receives the filament 40 therethrough in guiding relation after the filament passes from the guide roller 276. From the guide piece 285 the filament 40 passes through the guide bushings 174 and 194. By mounting the support rod 280 for rotation about its axis, it will be seen that as the radius of the wound filament 40 on the supply reel 38 decreases, the plane of the guide pulley 276 may change to different attitudes such that the plane of the guide pulley always contains the filament 40 as the filament approaches the pulley 276.

By supporting the rotatable guide pulley 276 at a constant or fixed radius from the axis of supply reel 38, the radius from which the filament 40 is drawn to the guide bushing 194 preparatory to twining remains constant throughout unwinding and reduction in radius of the filament on the supply reel. The force required to draw the filament 40 from the supply reel 38 over the guide roller 276 is thus maintained substantially constant so that the filament 40 is under substantially constant uniform tension throughout a twining operation. It will be appreciated that because the rear supply reel 34 is nonrotatably mounted and the forward supply reel 38 is biased against rotation by the counterweight 94, the payoff arm 232 associated with each supply reel will rotate about the axis of the supply reel during pay-out of the filaments 36 and 40 due to the force component normal to the plane containing the axes of the payoff arm and associated rod 280.

A counterbalance support arm 286 and associated counterbalance weight 288 are secured to each annular support member 234 so as to extend radially outwardly therefrom diametrically opposite the associated payoff arm 232 whereby to counterbalance the arms 232 and facilitate uniform rotation of the payoff arms during pay-out of the elongate filaments 36 and 40 from the supply reels 34 and 38.

In operation, the elongate filament 36 from the rear supply reel 34 is guided over the guide pulley 276' and guide piece 285' on the rear payoff arm 232' from which it is passed through the guide passages 108, 138 and 140 in the adapter shaft 110, pulley 118 and flyer shaft 76, respectively. The filament 36 is then reeved partially about the guide pulleys 142, 152, 166 and 168 on the flyer guide means 50 whereafter it is passed through the guide bushing 194 and tubular flyer shaft 158. The elongate filament 40 on the forward supply reel 38 is guided over the guide pulley 276 and guide piece 285 on the forward payoff arm 232 from which it passes through the guide bushings 174 and 194 and through flyer shaft 158.

The elongate filaments 36 and 48 from each twining station 16*a, b* and *c* are passed from their respective flyer shafts 158 to the cabling device 14 and connected thereto in a known manner. The cabling device 14 is of a known design, such as commercially available from Winding Machine Corporation. The cabling device 14 is adapted to cable the pairs of elongate filaments from the three twining stations 16*a, b* and *c* and in so doing draws the filaments from the twining apparatus 12 under axial tension. As the filaments 36 and 40 are drawn from the twining apparatus 12, the flyer arms 146 and 156 are rotated by the drive motor 198 at a selected rotational speed to twist or twine the filaments about each other at the guide bushing 194 whereafter the twined filaments are passed through the flyer shaft 158 and guided to the cabling device 14. The drive motor 198 of the twining apparatus 12 is operatively associated with the cabling device 14, such as indicated schematically at 290, so that the rotational speed of the flyer arms 146 and 156 is in direct predetermined relation to the rate of axial travel of the filaments 36 and 40 to establish the desired twining or twisting of the filaments whereby the desired "lay" is obtained.

As the elongate filaments 36 and 40 are unwound from their respective supply reels 34 and 38 over the associated payoff arms 232' and 232, the elongate filaments are maintained under substantially constant axial tension. The constant tension in the elongate filaments 36 and 40 results from the fact that the filaments are drawn from the guide pulleys 276 and 276' at a constant radial distance from the axis of rotation of the respective supply reels 34 and 38 so that the decreasing radius of the wound filaments on the reels during unwinding does not adversely vary the tension in the elongate filaments as has heretofore been experienced.

Thus, in accordance with the present invention a system for twining and cabling elongate filaments is provided which employs a unique twining apparatus 12 coupled with a cabling device 14 to facilitate improved uniform twisting or twining of pairs of elongate filaments, while simultaneously providing twining and cabling in one operation whereby to reduce floor space requirements and manufacturing costs. In known twining and cabling operations, the filament supply reels are generally subjected to substantial vibration which varies the tension in the associated elongate filaments being paid out by the reels. In accordance with the present invention, the payoff flyer means 44 and 46 operatively associated with supply reels, and particularly the payoff flyer means 46 associated with the forward floating supply reel 38, are operative to maintain substantially constant tension in the elongate filaments 36 and 40 without adverse affects resulting from vibration of the various components of the apparatus.

While the flyer arms 146 and 156 are illustrated as being arm members having substantially greater length than width, and the payoff arms 232 and 232' are illustrated as comprising rod-like arms, these elements may take other configurations such as disc shape and the like. It is preferred, however, that these elements be made of suitable strength lightweight material such as aluminum.

While a preferred embodiment of the invention has been illustrated and described, it will be understood by those skilled in the art that changes and modifications may be made therein without departing from the invention in its broader aspects. Various features of the invention are defined in the following claims.

What is claimed is:

1. Apparatus for uniformly twining a pair of elongate filaments, comprising, in combination, frame means defining forward and rearward ends of said apparatus, first supply reel means adapted to have a first elongate filament wound thereon and being nonrotatably supported by said frame means with the axis of said first reel means substantially horizontal, first payoff arm means supported forwardly of said first supply reel means for rotation about and in a plane substantially perpendicular to the axis of said first supply reel means, said payoff arm means including guide means thereon positioned radially outwardly from the axis of said first reel means a distance greater than the maximum wound radius which said first filament may have on said first reel, said guide means being adapted to receive said first elongate filament in guided relation therewith and being cooperative with said first filament to cause rotation of said first payoff arm means and effect let-off of said first filament from said first reel means under substantially constant tension when said first filament is subjected to an axial force sufficient to draw said first filament over said guide means from said first reel means, second supply reel means adapted to have a second elongate filament wound thereon and being supported by said frame means forwardly of said first supply reel means with the axis of said second supply reel substantially horizontal, second payoff arm means supported forwardly of said second supply reel means for rotation about and in a plane substantially perpendicular to the axis of said second supply reel means, said second payoff arm means including second guide means thereon positioned radially outwardly from the axis of said second reel means a distance greater than the maximum wound radius which said second filament may have on said second reel, said second guide means being adapted to receive said second elongate filament in guided relation therewith and being cooperative with said second filament to cause rotation of said second payoff arm means and effect let-off of said second filament from said second supply reel means under substantially constant tension when said second filament is subjected to an axial force sufficient to draw said second filament over said second guide means from said second supply reel means, flyer means supported by said frame means for guiding said first elongate filament around said second supply reel means and associated second payoff arm means as said first filament is paid out from said first supply reel means, means for receiving said second elongate filament from said second payoff arm means and positioning said second elongate filament in substantially side-by-side relation with said first filament after said first filament is guided around said second reel means and said associated second payoff arm means, and drive means operatively associated with said flyer means in a manner to effect rotation of said flyer guide means substantially about the axis of said second supply reel means so as to effect twining of said first and second elongate filaments about each other after they are positioned in said side-by-side relation.

2. Apparatus as defined in claim 1 including control means operatively associated with each of said first and second payoff arm means to selectively control the freedom of rotation thereof.

3. Apparatus as defined in claim 2 wherein each of said first and second payoff arm means includes a generally planar braking surface thereon, said control means including a friction pad engageable with each of said braking surfaces, and means for selectively adjusting the pressure applied by said friction pads against said planar surfaces.

4. Apparatus as defined in claim 3 including means biasing said friction pads against said braking surfaces.

5. Apparatus as defined in claim 1 including a substantially horizontal support shaft for each of said supply reels, and wherein said first and second payoff arm means are each supported by the said support shaft associated with each of said first and second supply reels.

6. Apparatus as defined in claim 1 wherein said second supply reel means is supported by said frame means for rotation about its longitudinal axis, and including means biasing said second reel means against rotation about its said longitudinal axis.

7. Apparatus as defined in claim 6 wherein said biasing means comprises a stability weight secured to said second reel means so as to substantially prevent rotation thereof.

8. Apparatus as defined in claim 1 wherein said second supply reel means is supported in axial alignment with said first supply reel means, and wherein said flyer means includes a pair of lightweight flyer arms supported for rotation about and in planes substantially perpendicular to the axis of said second supply reel means, said flyer arms being disposed on opposite axial ends of said second supply reel means, said flyer means including filament guide means supported by said flyer arms between corresponding ends thereof radially outwardly from said second reel means, said filament guide means being adapted to guide said first filament between said corresponding ends of said flyer arms about said second supply reel means.

9. Apparatus as defined in claim 8 including a pair of cables secured to and between corresponding ends of said flyer arms, said filament guide means comprising a plurality of guide elements supported in spaced relation along said pair of cables.

10. Apparatus as defined in claim 9 wherein each of said flyer arms extends radially outwardly in diametrically opposite directions from its axis of rotation, and including a pair of cables interconnecting the corresponding radial ends of said flyer arms, at least one pair of said cables supporting said filament guide elements thereon.

11. Apparatus as defined in claim 10 including counterbalance means supported on each of said flyer arms to balance said flyer arms about their said axes of rotation.

12. Apparatus as defined in claim 10 wherein said flyer arms are supported independently of each other, and wherein said drive means include a drive motor operative to effect rotation of said flyer arms in synchronized relation.

13. Apparatus as defined in claim 1 including cabling means adapted to receive a plurality of pairs of twined elongate filaments and effect cabling thereof, said cabling means being adapted to subject said filaments to axial tension sufficient to draw said filaments from said supply reels, said drive means being operatively associated with cabling means so as to effect rotation of said flyer means in direct relation to the rate at which said cabling means draws said filaments from said reels.

14. Apparatus as defined in claim 1 wherein each of said first and second payoff arm means extends radially outwardly from its axis of rotation in diametrically opposed directions, and including counterweight means disposed on the end of each of said payoff arm means opposite said guide means thereon to balance said payoff arm means about their axes of rotation.

15. Apparatus as defined in claim 1 wherein said guide means on said first and second payoff arm means each comprises a guide pulley supported such that the plane of each of said guide pulleys always contains the associated elongate filament paid out from the corresponding supply reel as said filaments approach said guide pulleys.

16. The apparatus of claim 15 including means operatively associated with each of said payoff arm means to facilitate varying the freedom of rotation of said payoff arm means relative to said supply reels.

17. In combination with a nonrotatably supported supply reel having a longitudinal axis and adapted to support an elongate filament in wound relation thereon; payoff means including a payoff arm supported for rotation substantially about the axis of said supply reel in a plane perpendicular to said axis, said payoff means including guide pulley means carried by said arm at a position spaced radially outwardly from said wound filament on said reel and adapted to receive said filament from said reel in guiding relation thereon, said payoff arm being rotatable relative to said reel so as to effect pay-out of said filament from said reel under substantially constant tension when the filament is reeved over said guide pulley means and is subjected to an axial force sufficient to draw said filament from said guide pulley means.

18. The combination as defined in claim 17 wherein said payoff arm extends radially outwardly from its axis of rotation in diametrically opposed directions, and including counterweight means disposed on the end of said arm opposite said guide pulley means to balance said arm about its axis of rotation.

19. The combination of claim 17 wherein said guide pulley means comprises a guide pulley supported by said payoff arm such that the plane of said guide pulley always contains the elongate filament paid out from the reel as it approaches said guide pulley.

20. The combination of claim 17 including means operatively associated with said payoff arm to facilitate varying the freedom of rotation thereof relative to said reel.

21. A system for twining pairs of elongate filaments and cabling said twined filaments, said system including twining apparatus comprising frame means, a plurality of twining stations supported by said frame means, each of said twining stations defining a longitudinal axis disposed parallel to and spaced from the axes of the other twining stations, each of said twining stations including rearward and forward supply reels disposed in substantially horizontal axial alignment, each of said supply reels being adapted to support an elongate filament in wound relation thereon, payoff arm means operatively associated with each of said supply reels and adapted to effect payout of said elongate filaments from said reels under substantially constant tension when said filaments are subjected to axial forces sufficient to draw said filaments from said supply reels, each of said twining stations further including rotatable flyer means supported by said frame means and adapted to guide the elongate filament from the rear supply reel about the forward supply reel without interference therewith, means in each twining station for receiving the rear filament from said flyer means and the forward filament from the corresponding payoff arm means and positioning said filaments in paired side-by-side relation, means for rotating said flyer means in a manner to twine said paired side-by-side filaments, and cabling means adapted to receive said twined pairs of elongate filaments from said twining stations and subject said filaments to said axial forces sufficient to draw said filaments from said supply reels, said cabling means being adapted to cable said twined pairs of elongate filaments about each other along their longitudinal lengths.

22. The system of claim 21 wherein said longitudinal axes of said twining stations are substantially coplanar.

23. The system of claim 21 including three twining stations having parallel coplanar longitudinal axes.

24. The system of claim 21 wherein said means for rotating said flyer means is operatively associated with said cabling means so as to selectively rotate said flyer means in synchronized relation to the rate at which said filaments are drawn from said supply reels by said cabling means.

* * * * *